US006993830B2

(12) United States Patent
Shimizu et al.

(10) Patent No.: US 6,993,830 B2
(45) Date of Patent: Feb. 7, 2006

(54) METHOD OF MANUFACTURING A KEY TOP FOR A PUSH-BUTTON SWITCH

(75) Inventors: Masanori Shimizu, Tokyo (JP); Kazuo Kikuchi, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 95 days.

(21) Appl. No.: 10/292,482

(22) Filed: Nov. 13, 2002

(65) Prior Publication Data

US 2003/0102204 A1 Jun. 5, 2003

(30) Foreign Application Priority Data

Nov. 16, 2001 (JP) ..... 2001-351130
Jun. 20, 2002 (JP) ..... 2002-180232

(51) Int. Cl.

*H01H 11/00* (2006.01)
*H01H 11/02* (2006.01)
*H01H 11/04* (2006.01)
*H01H 65/00* (2006.01)

(52) U.S. Cl. ..... 29/622; 29/527.1; 200/310; 200/341; 428/189; 428/195.1; 264/132; 264/259; 156/233; 156/234; 156/235; 156/238; 156/239; 156/240; 156/241

(58) Field of Classification Search ..... 29/622, 29/527.1; 200/310, 341; 428/195.1, 189; 264/132, 259; 156/233, 235, 234
See application file for complete search history.

(56) References Cited

U.S. PATENT DOCUMENTS

| | | | | |
|---|---|---|---|---|
| 3,235,395 A | | 2/1966 | Scharf | |
| 4,465,538 A | | 8/1984 | Schmoock | |
| 5,489,355 A | * | 2/1996 | Shimizu et al. | 156/230 |
| 5,891,289 A | * | 4/1999 | Zemel | 156/235 |
| 5,900,096 A | * | 5/1999 | Zemel | 156/233 |

FOREIGN PATENT DOCUMENTS

| | | |
|---|---|---|
| EP | 1 081 728 A2 | 3/2001 |
| JP | 01296290 | 11/1989 |
| JP | 2000-268667 | 9/2000 |

OTHER PUBLICATIONS

European Search Report dated Feb. 19, 2003.
Communication pursuant to Article 96(2) EPC.

* cited by examiner

*Primary Examiner*—A. Dexter Tugbang
*Assistant Examiner*—Tim Phan
(74) *Attorney, Agent, or Firm*—Rader, Fishman & Grauer PLLC

(57) ABSTRACT

A method of manufacturing a key top for a push-button switch according to the present invention includes forming a hot-melt adhesive layer on a resin key top so as to have a shape corresponding to a display portion for displaying a letter, symbol, or other indicia, and transferring a metallic thin film layer onto the hot-melt adhesive layer. Therefore, the metallic thin film layer is not damaged due to coating of the hot-melt adhesive layer, and positioning of the display portion is unnecessary. Further, when a transfer resin layer is formed on the metallic thin film layer, oxidation of the metallic thin film layer or damages thereto can be prevented.

20 Claims, 8 Drawing Sheets

METHOD OF MANUFACTURING A KEY TOP FOR A PUSH-BUTTON SWITCH

BACKGROUND OF THE INVENTION

CROSS REFERENCE TO RELATED DOCUMENTS

This application claims priority to Japanese Patent Application Numbers: 2001-351130, filed on Nov. 16, 2001 and 2002-180232, filed on Jun. 20, 2002.

1. Field of the Invention

The present invention relates to a key top used for a push-button switch of communication devices such as a mobile telephone, an automobile telephone, or a remote controller, or for a push-button switch of various other electric/electronic devices, and to a method of manufacturing the key top.

2. Description of the Related Art

As a conventional cover member for a push-button switch used in a communication device, in particular a mobile communication device, such as a mobile telephone or an automobile telephone, there has been widely used a cover member for an illuminated push-button switch consisting of a transparent resin key top and a transparent elastic keypad. Of such cover members, those which tend to be particularly preferred by the market are cover members in which the entire surface of the resin key top illuminates, and a display surface which has a display portion for displaying a letter, symbol, or the like exhibits both a metal-like luster and illuminance (transparency) (refer to JP 2000-268667A for a relevant example). The reasons for this favorable market acceptance include enhanced decorative property due to the metal-like luster of the display surface of the resin key top, which is distinct from simple color finishing, and improved visibility in dark places afforded by the illuminance of the display portion and the display surface.

Incidentally, a variety of methods have been conventionally employed in an attempt to obtain such a resin key top exhibiting both a metal-like luster and illuminance. As one example thereof, there is known a method in which a metal is secured on a resin key top by vapor deposition, sputtering or the like to form a metallic thin film layer. In this method, however, the key top is obtained through batch production using a vacuum apparatus, and thus the method suffers from such problems as low production efficiency and high costs.

In view of this, the present inventor has carried out intensive studies with a view to finding a simpler method for obtaining the above-described resin key top and has arrived at the following method. That is, in accordance with the method, as shown in FIGS. 9A and 9B, a metallic thin film layer 2 is formed first on a releasable sheet material 1, a hot-melt adhesive layer 3 is further formed by coating on the metallic thin film layer 2, and the metallic thin film layer 2 is transferred onto a predetermined position of a transparent resin key top 4.

However, according to this method, it is necessary to align the resin key top 4 and the hot-melt adhesive layer 3 relative to each other when transferring the metallic thin film layer 2 onto the resin key top 4. At this time, a display portion 5 that appears on the resin key top 4 can be displaced easily in a direction of a plane indicated by the arrow, resulting in further reduction in yield.

In addition, another problem found is that since the hot-melt layer 3 is formed on top of the metallic thin film layer 2, there are cases where the metallic thin film layer 2 is bent or otherwise damaged during coating of the hot-melt adhesive layer 3, and this frequently leads to reduction in yield.

Further, deformation of the releasable sheet material 1 was found as another problem further compounding the problem of yield reduction. That is, it is found that, due to the pressure and heat applied when coating the hot-melt adhesive layer 3, the degree of extension and deformation of the releasable sheet material 1 differs between a portion thereof on which the hot-melt adhesive layer 3 is coated and a portion thereof on which it is not coated, and such varying deformations cause positional displacement of the display portion 5.

The present invention has been attained as a result of seeking a way to overcome the above drawbacks of this method, which is a method with which further improvement of production efficiency can be anticipated in comparison to the aforementioned vapor-deposition or sputtering method, by using a hot-melt adhesive layer 3 that is easy to handle and excellent in quick-drying property.

That is, an object of the present invention is to provide a method of manufacturing a key top used for a push-button switch, which does not cause damages to a metallic thin film layer, which dispenses with the necessity to perform highly accurate positional alignment between a resin key top and the metallic thin film layer during a transfer step, and which enables not only high-yield and a high quality level but also high production efficiency.

SUMMARY OF THE INVENTION

In order to attain the above object, according to the present invention, there is provided a method of manufacturing a key top for a push-button switch, the method including forming a hot-melt adhesive layer on a resin key top so as to have a shape corresponding to a display portion for displaying a letter, symbol or the like, and transferring a metallic thin film layer onto the hot-melt adhesive layer to thereby form a resin-key top with a metallic tint.

According to this manufacturing method, a hot-melt adhesive layer is formed in advance over a predetermined location of a resin key top constituting a display portion, for example on the bottom surface of the resin key top, so as to have a shape corresponding to the display portion. Then, a metallic thin film layer is transferred onto the hot-melt adhesive layer. Therefore, there is virtually no possibility of the metallic thin film layer being damaged due to coating of the hot-melt adhesive layer thereon. Further, since the hot-melt adhesive layer is formed in advance on the resin key top side so as to have a shape corresponding to the display portion, it is not necessary to perform positioning of the display portion when transferring the metallic thin film layer onto the resin key top. As a result, a resin key top with a high quality level can be obtained, and improved yield can be attained. In addition, since this method utilizes a hot-melt adhesive layer that is easy to handle and excellent in quick-drying property, the production efficiency can be markedly improved as compared with the conventional vapor deposition method.

Further, in the above-described method of manufacturing a key top for a push-button switch, the hot-melt adhesive layer may be formed by one of the following methods of: coating a hot-melt adhesive so as to have a die-cut shape corresponding to the display portion; and coating a hot-melt adhesive so as to have the same shape as the display portion. Of those, particularly the former method, in which the hot-melt adhesive layer is formed by coating a hot-melt adhesive so as to have a die-cut shape corresponding to the display portion, the hot-melt adhesive layer allows the metallic thin film layer to be transferred onto a large area of the resin key top. Thus, this method is particularly preferred for use in the aforementioned manufacturing method in which the metallic thin film layer is not easily damaged.

In the manufacturing method of the present invention as described above, for example a metal foil or the like can be used for the metallic thin film layer. However, from the viewpoint of further improvement in production efficiency, it is preferable to form the metallic thin film layer on a sheet material having release property and then transferring it onto the hot-melt adhesive layer. That is, when the above-described releasable sheet material is used, the metallic thin film layer can be readily detached from the sheet material so that burrs are not easily generated, thus obviating the need to perform a burr removal process or the like using laser irradiation in subsequent manufacturing steps. Further, as for a method of forming the metallic thin film layer on the releasable sheet material, it is further preferred to perform vapor deposition of low-cost aluminum by means of a vacuum deposition method that ensures excellent detachability of the metallic thin film layer from the sheet material upon its transfer.

Further, in accordance with the manufacturing method of the present invention, it is also possible to form a protective layer on a releasable sheet material and further form a metallic thin film layer thereon in laminate, and thereafter transfer the metallic thin film layer and the protective layer onto a hot-melt adhesive layer at the same time. Since the protective layer is provided in advance between the sheet material and the metallic thin film layer and then the metallic thin film layer and the protective layer are transferred at the same time, the protective layer appears on the key top surface obtained after the transfer process. Therefore, contamination of the metallic thin film layer or degradation thereof due to oxidation or the like does not occur during the period of from the transfer step until subsequent steps such as coating of a colored layer. In addition, the protective layer is formed in advance, thus eliminating the need to perform a step of forming the protective layer after the transfer step. Moreover, the protective layer fits well with the colored layer, thus improving its adhesion with the colored layer. Further, during the transfer process, separation takes place between the protective layer and the releasable sheet material (in a case where there is used a releasable sheet material in which a release layer is provided on a base film, such separation takes place on the boundary between the protective layer and the above release layer, or within the above release layer), thus eliminating the possibility that the metallic thin film layer remains on the releasable sheet side and thereby achieving enhanced transferability of the metallic thin film layer.

Further, in accordance with the manufacturing method of the present invention, it is possible to further form a transfer resin layer on the metallic thin film layer and transfer the metallic thin film layer onto the hot-melt adhesive layer through the transfer resin layer. The reasons for adopting such arrangement are as follows. That is, in the case where the metallic thin film layer is formed on the releasable sheet material and then this is put under storage, since the metallic thin film layer is exposed to the outside air, it is assumed that there will arise a problem in that it undergoes oxidation, corrosion or discoloration, or it becomes susceptible to deposition of contaminants or damages. In view of this, the transfer resin layer is formed to protect the metallic thin film layer, thus making it possible to avoid occurrence of such a problem. In addition, the provision of the transfer resin layer allows improved adhesion with the hot-melt adhesive layer, whereby generation of burrs can be suppressed.

Then, in accordance with the manufacturing method of the present invention as described hereinabove, it is possible to manufacture any one of the following key tops for a push-button switch, that is, a key top in which, of a metal-like luster and illuminance (transparency), greater emphasis is placed on the metal-like luster; one in which greater emphasis is placed conversely on the illuminance (transparency); and one which combines the metal-like luster and the illuminance (transparency) in good balance, for which the market demand is particularly high. In any of these key tops for a push-button switch, the metallic thin film layer is formed at a thickness of 5 to 500 nm. The thickness of the metallic thin film layer is set as not smaller than 5 nm because with a thickness below 5 nm, it becomes devoid of the metallic tint. The thickness is set as not greater than 500 nm because a thickness exceeding 500 nm causes detachability of the metallic thin film layer upon its transfer to be deteriorated so that burrs are easily generated on cut edges of the layer, thus making it necessary to perform an additional burr removal process. Further, within the thickness range of 5 to 500 nm, the metallic thin film layer is to be formed at a thickness of 5 nm or more and below 100 nm when manufacturing a key top for a push-button switch in which greater emphasis is placed on the illuminance (transparency). On the other hand, when manufacturing a key top for a push-button switch in which greater emphasis is placed on the metal-like luster, the metallic thin film is to be formed at a thickness of 100 to 500 nm. Further, when manufacturing a push-button switch key top that combines the metal-like luster and illuminance (transparency) in good balance, the metallic thin film layer is to be formed at a thickness of 10 to 50 nm.

Although depending on the method of forming the metallic thin film layer and the material of the metal used, the aforementioned thickness of the metallic thin film layer may be set as an index of the metal-like luster and the illuminance (transparency) described above. However, its visible light transmission may also be set as another index. That is, if illuminance (transparency) is to be imparted to a key top for a push-down switch, the metallic thin film layer is formed with a visible light transmission of 1 to 60%. With a visible light transmission below 1%, while the metal-like luster afforded by the metallic thin film layer becomes satisfactory, the transparency of the obtained key top becomes insufficient so that it is deprived of illuminance, whereas visible a light transmission over 60% results in unsatisfactory metal-like luster. More practically, although depending on the kind, index of refraction, and configuration of the resin to be used as well as the material, index of refraction, and color tone of the metallic thin film layer, it is more preferable to form the metallic thin film layer with a visible light transmission of 5 to 40% in order to obtain a key stop for a push-button switch which exhibits both the metal-like luster and the illuminance (transparency) in good balance.

Note that the thickness and the visible light transmission of the metallic thin film layer described above are components that are independent of each other. Thus, there may arise a case in which the thickness for obtaining desired metallic luster and illuminance (transparency) falls within the range of 5 to 500 nm but the visible transmission at this time deviates from the range of 1 to 60%, or in which, conversely, the visible light transmission at this time falls within the range of 1 to 60% but the thickness deviates from the range of 5 to 500 nm. Needless to say, there is also a case where the thickness falls within the range of 5 to 500 nm and the visible light transmission falls within the range of 1 to 60% as well.

The term "visible light" referred to in the above description means an electromagnetic wave with a wave range that may be perceived as light by human eyes. Although there are individual differences with regard to a perceivable wave range, the lower limit wavelength is from 360 to 400 nm and the upper limit wavelength is from 760 to 830 nm. Different wavelengths give different color sensations. The term metal-like "luster" used herein includes both specular gloss and matted luster.

Further, the above-described manufacturing method may complementarily further include a step of irradiating laser light to the metallic thin film transferred onto the resin key top to remove unnecessary portions of the metallic thin film layer. With the above process, the metallic thin film layer can be formed only in a desired location of the resin key top so that, even if burrs remain slightly on cut edges of the metallic thin film layer upon transfer thereof, these can be easily removed by the laser light. In addition, even an extremely thin die-cut shape that would be difficult to produce by the transfer process can be easily formed with the laser light.

The above description of the present invention is not intended to limit the invention to the form disclosed herein, but rather the objects, benefits, features, and applications of the invention will become more apparent upon reading the description made hereinbelow with reference to the accompanying drawings. Further, it is to be understood that all modifications made as appropriate without departing from the spirit of the present invention fall within the scope of the present invention.

BRIEF DESCRIPTION OF THE DRAWINGS

The present invention will become more clearly appreciated as the disclosure of the invention is made with reference to the accompanying drawings. In the drawings:

FIGS. 1A and 1B are explanatory views showing manufacturing steps of a key top for a push-button switch in accordance with an embodiment of the present invention, in which FIG. 1A is a partial sectional view showing a state where a metallic thin film layer is laminated on a releasable sheet material, and FIG. 1B is a partial sectional view showing a state where a hot-melt adhesive layer is laminated on a resin key top.

FIGS. 2A and 2B are explanatory views showing steps performed subsequent to the manufacturing steps shown in FIGS. 1A and 1B, in which FIG. 2A is a partial sectional view showing a state where the metallic thin film layer is being transferred onto the hot-melt adhesive layer formed on the resin key top, and FIG. 2B is a partial sectional view showing a state where the hot-melt adhesive layer corresponding to the die-cut shape of a display portion is being formed.

FIGS. 3A and 3B are explanatory views showing steps performed subsequent to the manufacturing steps shown in FIGS. 2A and 2B, in which FIG. 3A is a partial sectional view showing a state where a colored layer is formed so as to bury the display portion of the resin key top, and FIG. 3B is a partial sectional view of a cover member (key sheet) for a push-button switch in which the key top for a push-button switch is secured onto a keypad through the adhesive layer.

FIGS. 9A and 9B are explanatory views showing manufacturing steps of a key top for a push-button switch which is obtained in the course of creating the present invention, in which FIG. 9A is a partial sectional view showing a state where a hot-melt adhesive layer is provided on a metallic thin film layer, and FIG. 9B is a partial sectional view for explaining that a display portion that appears on a resin key top is easily displaced in the direction of a plane indicated by the arrow.

DETAILED DESCRIPTION OF THE PREFERRED EMBODIMENTS

Figure 1A:
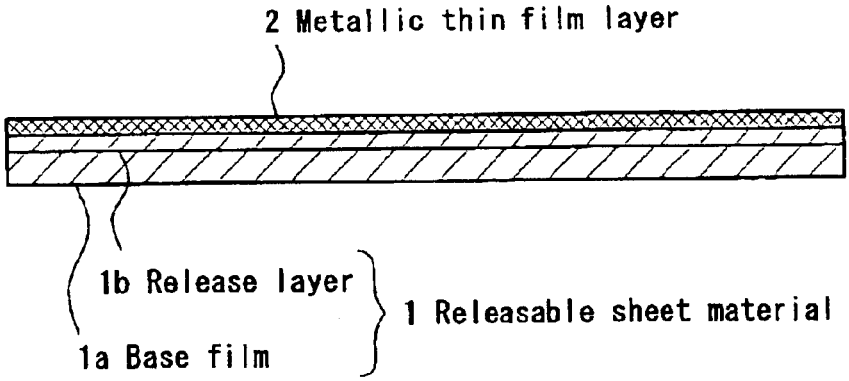

Hereinbelow, exemplary embodiments of the present invention will be described with reference to the drawings. Note that structural portions that are identical to those already explained in the description of the related art hereinabove are denoted by the same reference numerals, and duplicate explanation thereof will be omitted.

Here, as one example of a method of manufacturing a key top for a push-button switch in accordance with the present invention, a manufacturing method will be described in which a metallic thin film layer 2 is formed on a releasable sheet material 1, a hot-melt adhesive layer 3 is formed on a resin key top 4 by coating so as to have a shape corresponding to the shape of a display portion 5 for displaying a letter, symbol or other indicia, and the metallic thin film layer 2 is transferred onto the resin key top 4 through the hot-melt adhesive layer 3.

Figure 1B:
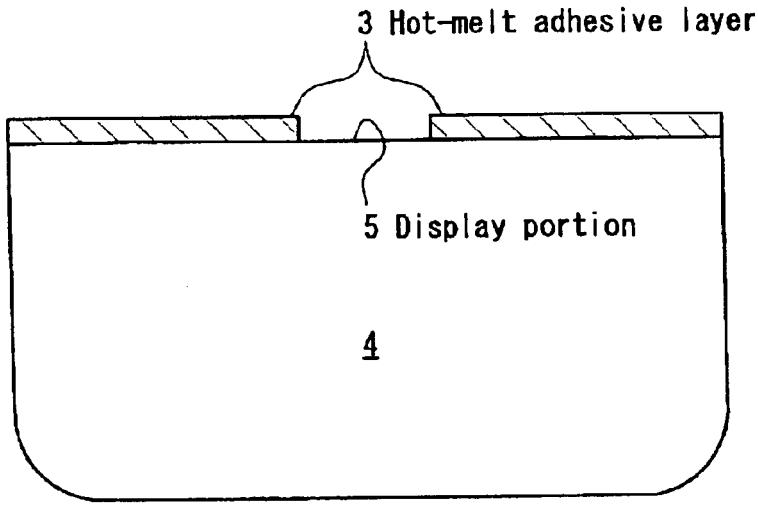

More specifically, as shown in FIGS. 1A and 1B, a release layer 1*b* is formed on a base film 1*a*, and then a metallic thin film layer 2 having a desired thickness and visible light transmission described later is formed on the release layer 1*b* (FIG. 1A). On the other hand, a hot-melt adhesive is coated on a resin key top 4 that is formed by molding. In this embodiment, the hot-melt adhesive is coated in a die-cut shape corresponding to the shape of the display portion 5 such as a letter, symbol, or pattern. Thus, the hot-melt adhesive layer 3 having a shape corresponding to the die-cut shape of the display portion 5 is formed (FIG. 1B).

Figure 2A:
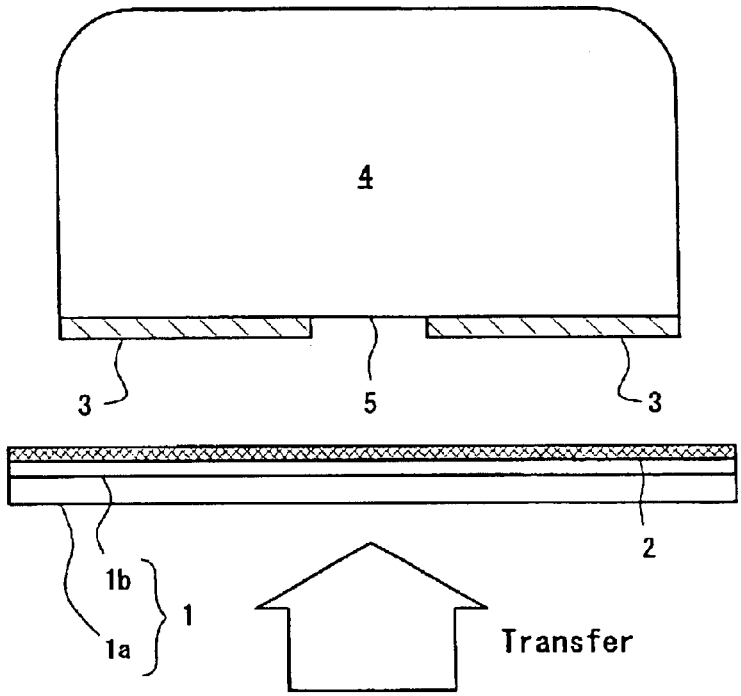
Figure 2B:
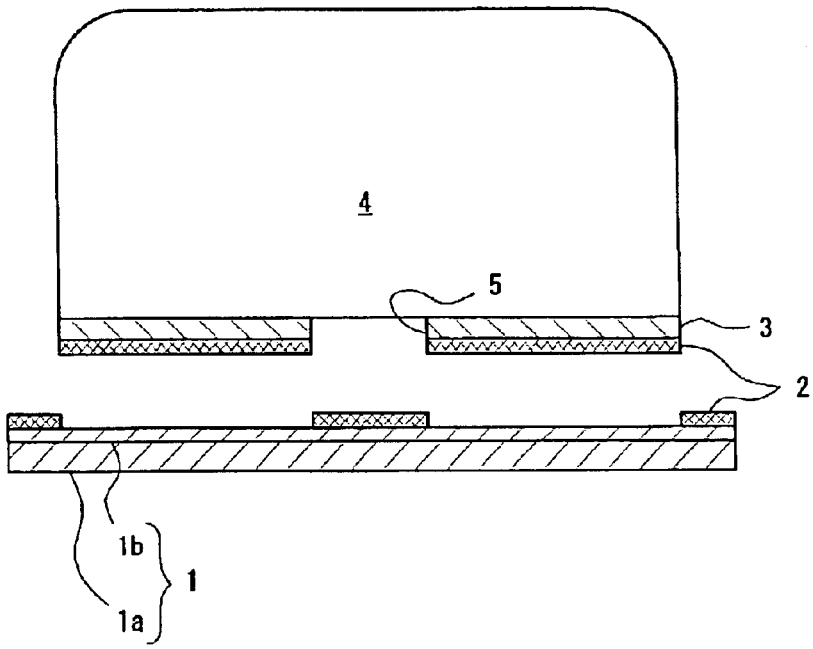
Figure 3A:
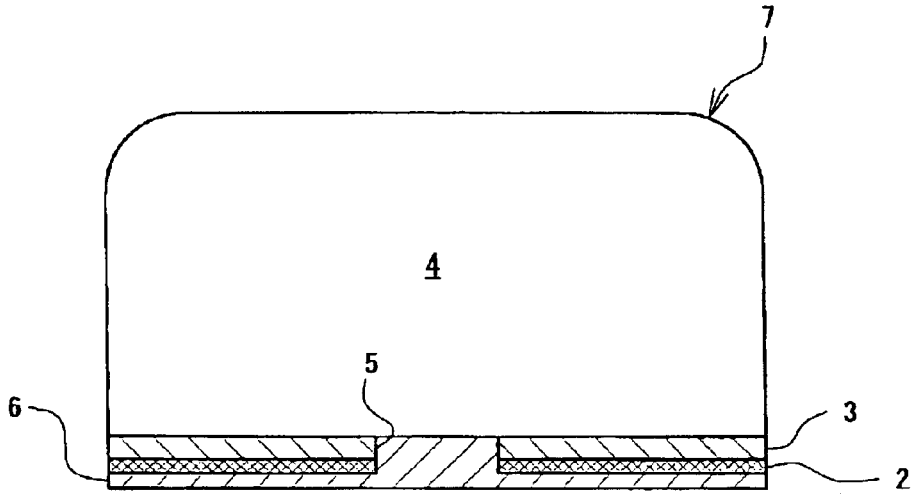
Figure 3B:
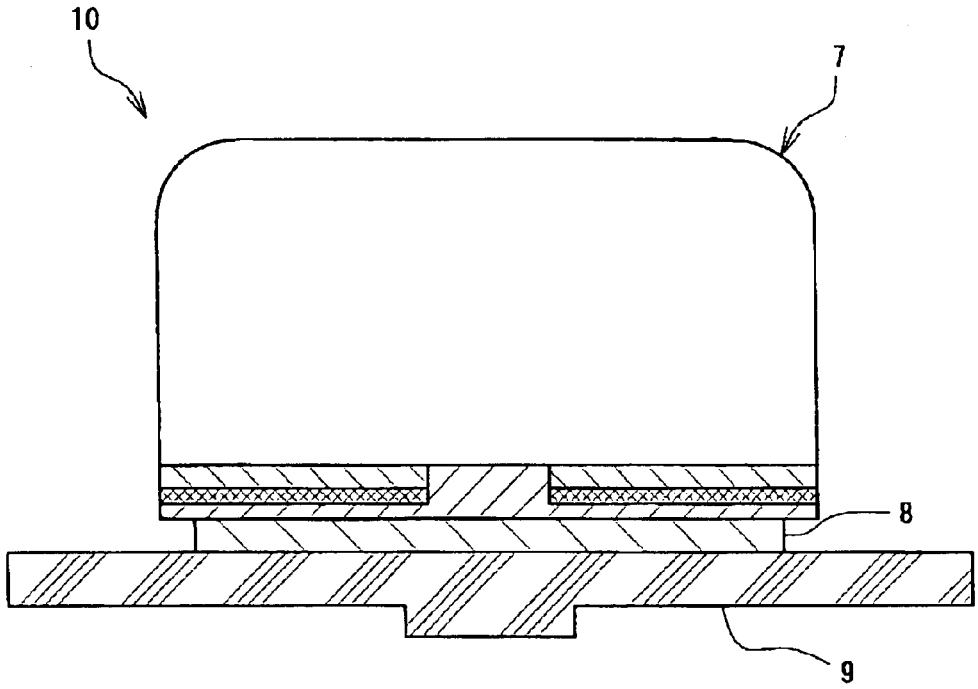

Next, as shown in FIGS. 2A and 2B, the metallic thin film layer 2 is heat-transferred onto the hot-melt adhesive layer 3 that is formed on the resin key top 4 (FIG. 2A). At this time, only the portions of the metallic thin film layer 2 which are to be contact-bonded onto the hot-melt adhesive layer 3 are neatly separated from the release layer 1*b* to be transferred onto the resin key top 4 (FIG. 2B). In this case, should unwanted burrs be left in cut edges of the metallic thin film layer upon the transfer thereof, laser light irradiation may be performed to remove such burrs. Further, in a case where a refined subtle shape that cannot be produced by the transfer process is required for the display portion 5, unnecessary portions of the layer may be cut away by laser light in a complimentary manner. And finally, as shown in FIGS. 3A and 3B, a colored layer 6 is formed so as to bury the display portion 5 of the resin key top 4, thereby obtaining a key top 7 for a push-button switch (hereinafter also referred to as the "push-button switch key top") manufactured in accordance with the manufacturing method of this embodiment (FIG. 3A). Then, the push-button switch key top 7 is secured through the adhesive layer 8 onto a keypad 9 formed of a rubber-like elastic body, thereby completing a cover member 10 (key sheet) for a push-button switch according to this embodiment (FIG. 3B).

In accordance with this embodiment, the hot-melt adhesive layer 3 is formed in advance on the resin key top 4 in a shape corresponding to the display portion 5, that is, in a die-cut shape corresponding to the display portion 5, and the metallic thin film layer 2 is transferred thereto. As a result, there is virtually no possibility of damages being sustained by the metallic thin film layer 2 such as is the case with the method of coating the hot-melt adhesive layer 3 in advance on the metallic thin film layer 2. The above method is particularly effective when forming the metallic thin film layer 2 by using the hot-melt adhesive layer 3 in the case where the transfer area becomes relatively large because the display portion 5 is formed as a die-cut shape.

Moreover, the hot-melt adhesive layer 3 is formed in advance on the resin key top 4 so as to have a die-cut shape corresponding to the display portion 5, whereby it becomes unnecessary to perform positional alignment of the display portion 5 when transferring the metallic thin film layer 2 onto the resin key top 4.

Therefore, the resin key top 4 having a high quality level of its display surface including the display portion 5 observed in the outer appearance can be obtained, and the yield is improved. In addition, due to the use of the hot-melt adhesive layer 3 that is easy to handle and excellent in quick-drying property, this manufacturing method enables improved production efficiency as compared with the conventional vapor deposition method.

Figure 4:
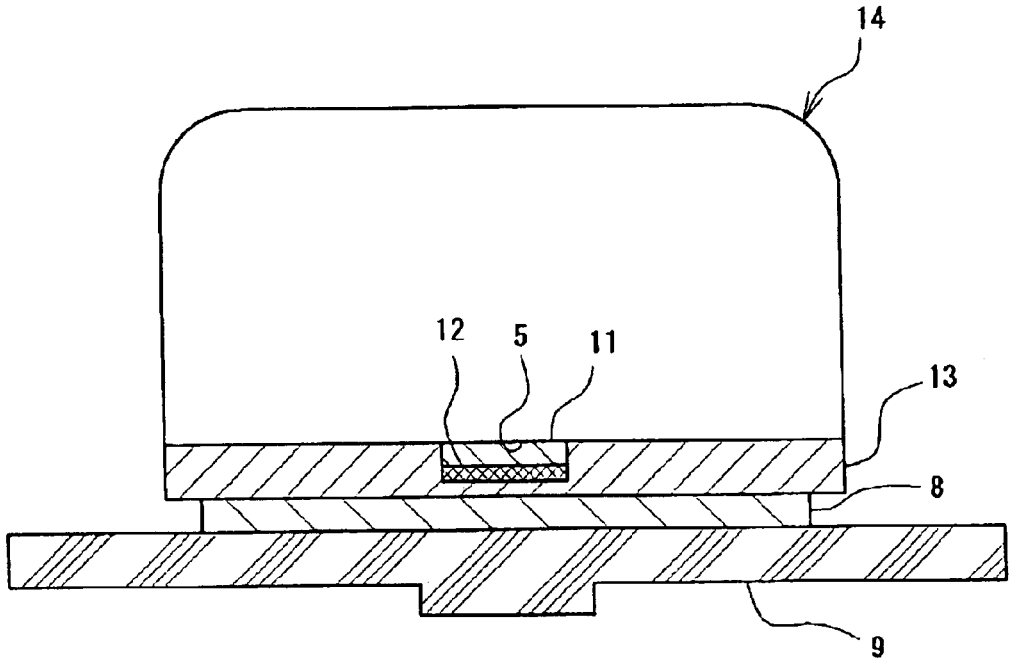
FIG. 4 is a partial sectional view showing a key sheet provided with a key top for a push-button switch according to another embodiment of the invention.

Note that, according to the above-described example, there is obtained the push-button switch key top 7 in which the hot-melt adhesive layer 3 is formed to have a die-cut shape corresponding to the display portion 5. However, as shown in FIG. 4, it is also possible to form a hot-melt adhesive layer 11 by coating hot-melt adhesive in the same shape as the display portion 5 and transferring a metallic thin film layer 12 onto the thus obtained hot-melt adhesive layer 11. In this case, there is obtained a push-button switch key top 14 having a colored layer 13 formed in the remaining portion thereof.

Figure 5:
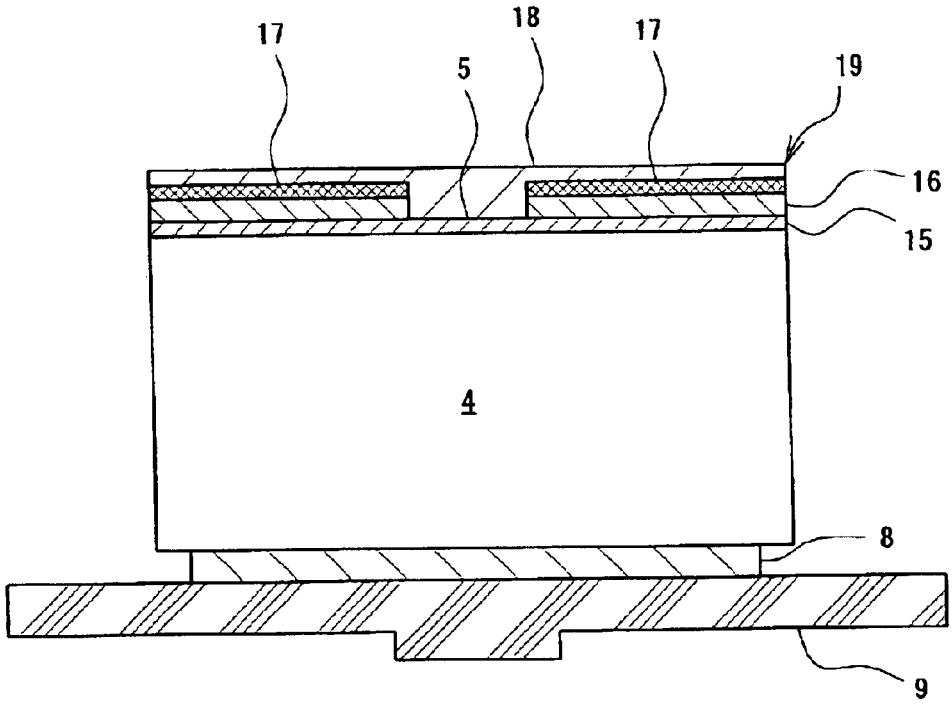
FIG. 5 is a partial sectional view showing a key sheet provided with a key top for a push-button switch according to still another embodiment of the invention.

Further, as shown in FIG. 5, it is also possible to form a colored layer 15 on the surface of the resin key top 4 first and then form a hot-melt adhesive layer 16 thereon so as to have a die-cut shape corresponding to the display portion 5, and transfer a metallic thin film layer 17 onto the hot-melt adhesive layer 16. When a protective layer 18 covering the metallic thin film layer 17 is further formed, a push-button switch key top 19 is obtained.

Further, in addition to the method in which the protective layer 18 is formed after the transfer of the metallic thin film layer 17, an alternative method may be adopted in which the protective layer 18 is formed on the releasable sheet material 1 first, and after forming the metallic thin film layer 17 thereon, the metallic thin film layer 17 is transferred together with the protective layer 18. According to this method, the metallic thin film layer 17 does not become exposed onto the key top surface after the transfer thereof, and thus the metallic thin film layer 17 is protected. Also, the method of providing the protective layer 18 to the releasable sheet material 1 in advance and transferring it together with the metallic thin film layer 17 may be employed in the case where the hot-melt adhesive layer 3 is formed on the resin key top 4 so as to have a die-cut shape corresponding to the display portion 5 and the metallic thin film layer 12 is transferred thereto, as well as in the case where the hot-melt adhesive layer 11 is formed so as to have the same shape as the display portion 5 and then the metallic thin film layer 12 is transferred thereto. In these cases, a push-button switch key top (not shown) having a protective layer provided between the metallic thin film layer 2 and the colored layer 6 shown in FIG. 3B and a push-button switch key top (not shown) having a protective layer provided between the metallic thin film layer 12 and the colored layer 13 shown in FIG. 4 are obtained, respectively.

As another embodiment of the method of manufacturing a key top for a push-button switch, there may be employed a method in which the metallic thin film layer 2, 12, 17 is formed on the releasable sheet material 1, and after forming a transfer resin layer 20, 21, 22 thereon, the metallic thin film layer 2, 12, 17 is transferred onto the hot-melt adhesive layer 3, 11, 16 through the transfer resin layer 20, 21, 22. In this case, after the above-described step of forming the metallic thin film layer 2, 12, 17, there may be performed a step of forming the transfer resin layer 20, 21, 22 on the metallic thin film layer 2, 12, 17 by gravure printing or the like.

Figure 6:
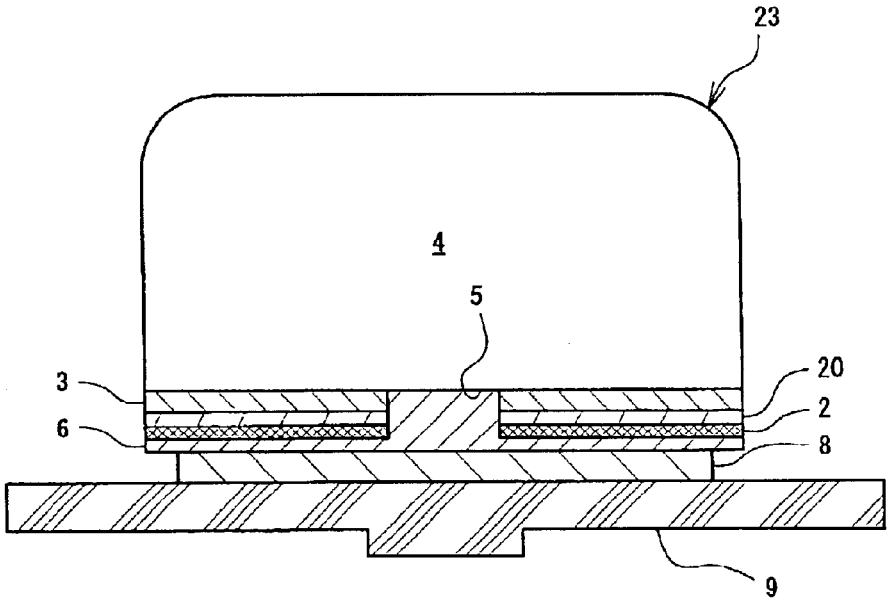
FIG. 6 is a partial sectional view showing a key sheet provided with a key top for a push-button switch according to still another embodiment of the invention.
Figure 7:
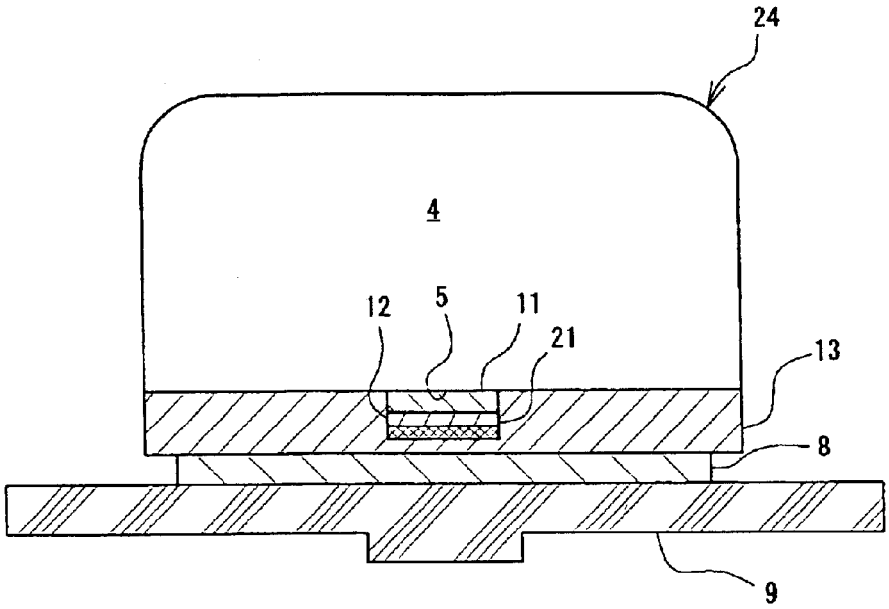
FIG. 7 is a partial sectional view showing a key sheet provided with a key top for a push-button switch according to still another embodiment of the invention.
Figure 8:
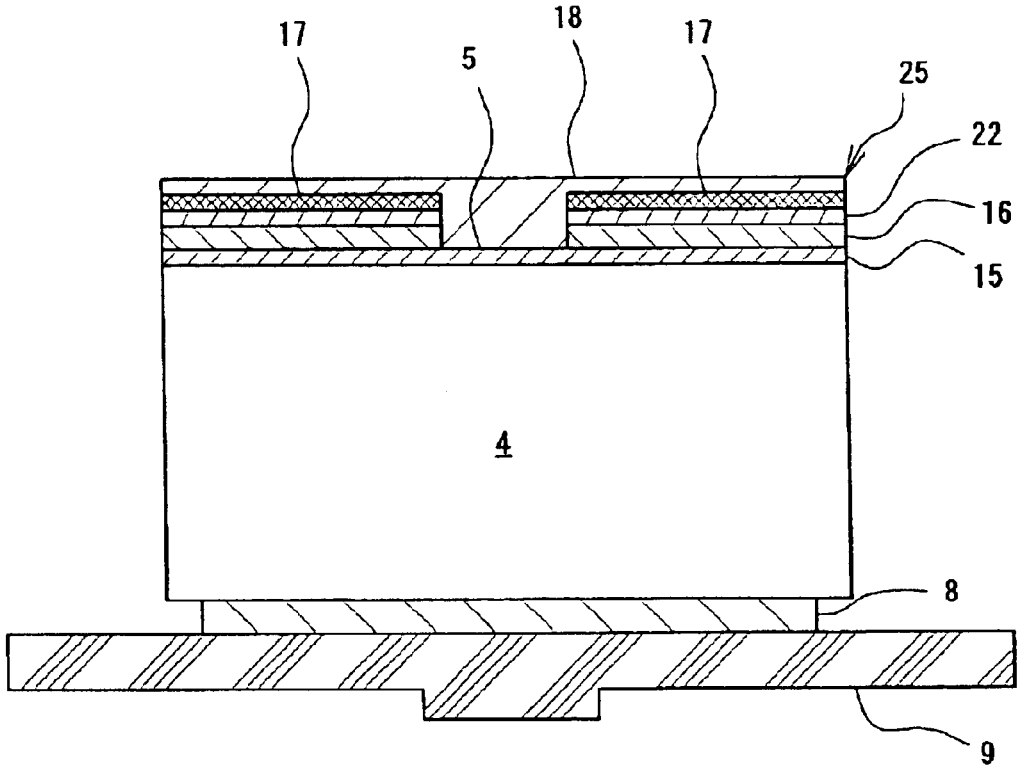
FIG. 8 is a partial sectional view showing a key sheet provided with a key top for a push-button switch according to still another embodiment of the invention.
Figure 9A:
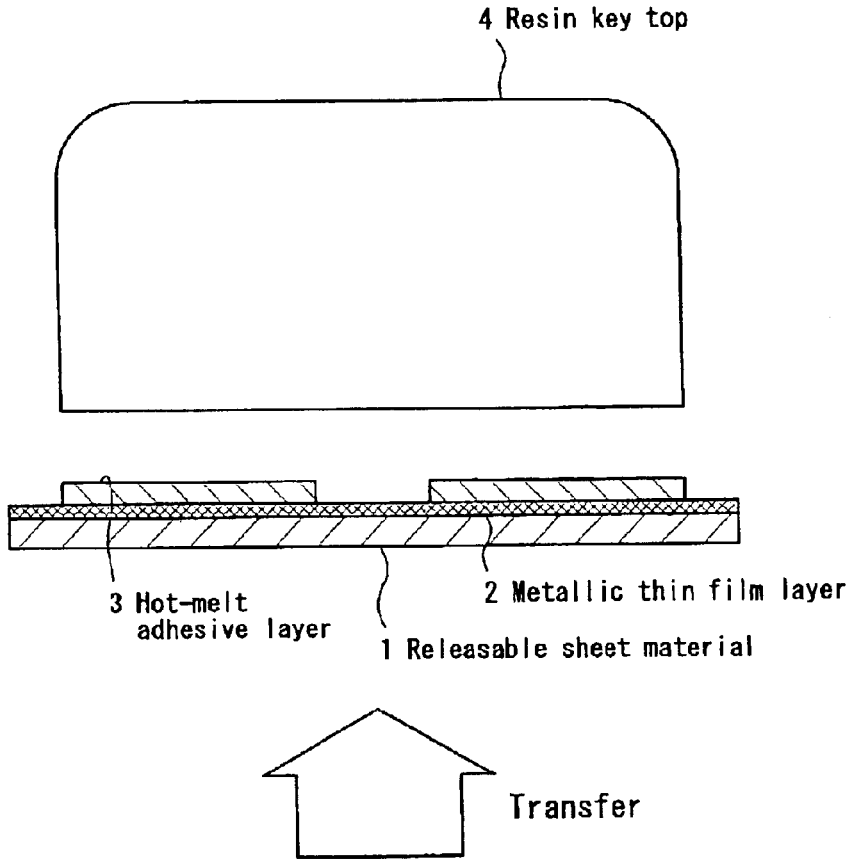
Figure 9B:
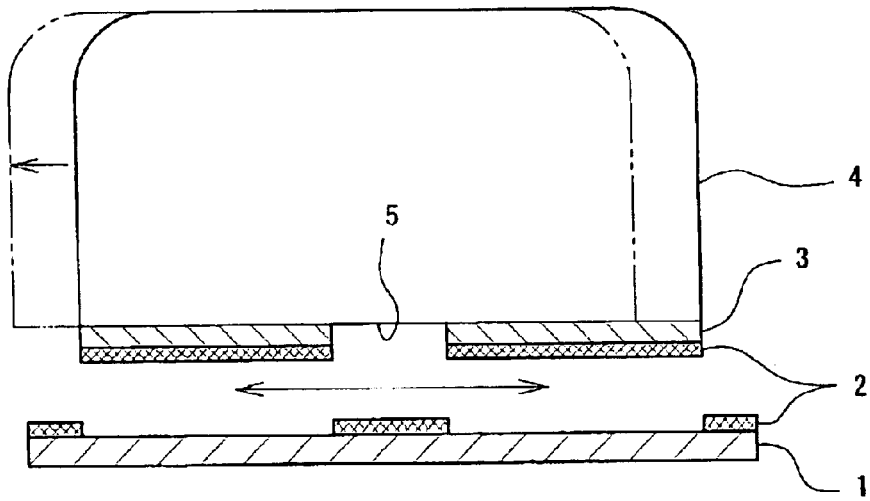

FIG. 6 shows a partial cross section of a key sheet provided with a push-button switch key top 23 obtained by forming the transfer resin layer 20 and forming the hot-melt adhesive layer 3 into a die-cut shape corresponding to the display portion 5. Also, FIG. 7 shows a partial cross section of a key sheet provided with a push-button switch key top 24 obtained by forming the transfer resin layer 21 and forming the hot-melt adhesive layer 11 into the same shape as the display portion 5. Further, FIG. 8 shows a partial cross section of a key sheet provided with a push-button switch key top 25 obtained by forming the transfer resin layer 22 and forming the hot-melt adhesive layer 16 on a surface of the resin key top 4 having the colored layer 15.

Further, also in the method of forming the transfer resin layer 20, 21, 22, it is possible to provide a protective layer to the releasable sheet material 1 in advance and form the transfer resin layer 20, 21, 22 after forming the metallic thin film layer 2, 12, 17 thereon.

Next, each structural member will be described in further detail.

Specific examples of the material that may be used for the metallic thin film layer 2, 12, 17 include titanium, iron, magnesium, tungsten, aluminum, nickel, chrome, tin, cobalt, zinc, manganese, copper, silver, and gold. Of those, aluminum is preferred for its low cost.

As methods of forming the metallic thin film layer 2, 12, 17 on the releasable sheet material 1, these may include: a physical vapor deposition method such as vacuum deposition, ion plating, or sputtering; a chemical vapor deposition method such as thermal CVD, plasma CVD or photo-assisted CVD; and rolling. Although any of these methods allow the metallic thin film layer 2, 12, 17 to be formed uniform and without unevenness, if, of those, the vacuum deposition is employed in particular to form the metallic thin film layer 2, 12, 17 on the releasable sheet material 1, the metallic thin film layer 2, 12, 17 can be readily detached during the transfer process. In addition to the aforementioned method of forming the release layer 1*a* on the base film 1*b* and then forming the metallic thin film layer 2, 12, 17 on the release layer 1*a*, it is also possible to form the metallic thin film layer 2, 12, 17 directly on the base film 1*b*.

Although actually depending on the method of its formation and the material of the metal used therefor, the metallic thin film layer 2, 12, 17 is generally formed at a thickness of 5 to 500 nm. The thickness is set as described above because, with a thickness below 5 nm, the metallic tint of the layer is diminished whereas with a thickness exceeding 500 nm, the metallic thin film layer 2, 12, 17 exhibits poor detachability upon its transfer so that burrs can be easily generated on the cut edges thereof, thus making it necessary to perform an additional burr removal process. Further, within the thickness range of 5 to 500 nm, the metallic thin film layer 2, 12, 17 is to be formed at a thickness of 5 nm or more and below 100 nm in the case where greater emphasis is placed on illuminance (transparency). On the other hand, in the case where greater emphasis is placed on the metal-like luster and the illuminance (transparency) can be almost ignored, the metallic thin film layer 2, 12, 17 is to be formed at a thickness of 100 to 500 nm. Also, in order to obtain the push-button switch key top 7, 14, 19 that exhibits both the metal-like luster and illuminance (transparency) in good balance, the metallic thin film layer 2, 12, 17 is to be formed at a thickness of 10 to 50 nm.

Further, a visible light transmission of the metallic thin film layer 2, 12, 17, rather than the thickness thereof, may be used as an index of the metal-like luster and the illuminance (transparency) described above. That is, if illuminance (transparency) is to be imparted to the push-button switch key top 7, 14, 19, the metallic thin film layer 2, 12, 17 is formed with a visible light transmission of 1 to 60%. With a visible light transmission below 1%, the transparency becomes insufficient which results in lack of illuminance, whereas visible light transmission over 60% results in an unsatisfactory metal-like luster. More practically, although depending on the kind, index of refraction, and configuration of the resin to be used as well as the material, index of refraction, and color tone of the metallic thin film layer, it is more preferable that the metallic thin film layer 2, 12, 17 is formed with a visible light transmission of 5 to 40% in order to obtain the push-button switch key top 7, 14, 19 which exhibits both the metal-like luster and the illuminance (transparency) in good balance.

As the releasable sheet material 1, a resin film is used. Examples of the resin films include a polyethylene terephthalate film, a polybutylene terephthalate film, a polyurethane film, a polyamide film, a polypropylene film, a polystyrene film, a fluorine film, an ionomer film, a polycarbonate film, and a polyvinyl chloride film. Among those resin films, the polyethylene terephthalate film is preferable in view of its processability, heat resistance, chemical resistance, and transparency. The releasable sheet material 1 may have a film thickness of approximately 12 $\mu$m to 350 $\mu$m, and preferably 12 $\mu$m to 100 $\mu$m in view of its transferability.

It is preferable that the release layer 1*a* be formed on the surface of the releasable sheet material 1, or surface treatment be performed on the releasable sheet material 1 per se, in order that the metallic thin film layer 2, 12, 17 is easily adhered or easily peeled off upon transfer processing.

The hot-melt adhesive layer 3, 11, 16 is formed by coating with a hot-melt adhesive. Examples of the hot-melt adhesive used include a resin-based hot-melt adhesive that is EVA-based, polyester-based, polyolefin-based, polyamide-based, acrylic-based, or the like, and a rubber-based hot-melt adhesive that is urethane-based, silicone-based, or styrene elastomer-based. The resin key top 4 is coated with the hot-melt adhesive by screen printing, pad printing, spray coating, or the like. It is preferable that the hot-melt adhesive be transparent or translucent and have excellent adhesiveness with respect to the material of the resin key top 4 to which it is adhered. Also, the hot-melt adhesive may be colored by dyes, pigments, or the like. If the hot-melt adhesive thus colored is used, the key top with a metallic tint having a chromatic color can also be provided. The thickness of the hot-melt adhesive layer 3, 11, 16 is preferably 1 to 20 $\mu$m in consideration of its transferability. This is because if the thickness is less than 1 $\mu$m, there is a defect in that coating work becomes difficult, while if the thickness is larger than 25 $\mu$m, the shape of the display portion 5 to be formed becomes less accurate.

On top of the metallic thin film layer 2, 12, 17 that is formed on the releasable sheet material 1, the transfer resin layer 20, 21, 22 is further formed. The transfer resin layer 20, 21, 22 serves to protect the metallic thin film layer 2, 12, 17, and contributes to improving the adhesiveness with respect to the hot-melt adhesive layer 3 when the metallic thin film layer 2, 12, 17 is to be transferred. That is, if the transfer resin layer 20, 21, 22 is formed on top of the metallic thin film layer 2, 12, 17, when storing the releasable sheet material 1 on which the metallic thin film layer 2, 12, 17 has been formed, the metallic thin film layer 2, 12, 17 can be prevented from oxidization due to air, moisture, or the like. Also, even in the case where it is touched by hand, the transfer resin layer 20, 21, 22 protects against adhesion of contaminants or damages to the metallic thin film layer 2, 12, 17. Accordingly, the push-button switch key top 23, 24, 25 can be produced which retains high quality and a metal-like luster regardless of the storage area or storage period. In addition, since the releasable sheet material 1 on which the metallic thin film layer 2, 12, 17 has been formed can be stored for a long period, mass production of the releasable sheet material 1 on which the metallic thin film layer 2, 12, 17 has been formed becomes possible, improving the production efficiency and reducing the manufacturing costs. Also, the transferability of the metallic thin film layer 2, 12, 17 is improved, whereby foils are more easily detached, and occurrence of flashes is suppressed.

As the transfer resin layer 20, 21, 22, a thermoplastic resin is used, and it is also preferable to use the thermoplastic resin that is added with a small amount of sub-component. The reason why the thermoplastic resin is used for the transfer resin layer 20, 21, 22 is, for example, that a thermoset resin causes a problem in that cracks occur after coating and is difficult to handle in view of the storage stability and workability. Another reason thereof is that the use of the thermoset resin deteriorates the transferability of the metallic thin film layer 2, 12, 17, so that burrs are more easily generated than the case of providing no such transfer resin layer, while the use of the thermoset resin improves the transferability more greatly as compared with the case of not providing the transfer resin layer 20, 21, 22, so that occurrence of burrs is suppressed. The reason why the use of the thermoset resin improves the transferability is conceivably that, since the transfer resin layer 20, 21, 22 is provided with adhesiveness, the adhesive force of the hot-melt adhesive 3, 11, 16 with respect to the transfer resin layer 20, 21, 22, becomes greater than the adhesive force of the hot-melt adhesive 3, 11, 16 with respect to the metallic thin film layer 2, 12, 17.

Examples of the thermoplastic resins used for the transfer resin layer 20, 21, 22 include a polyvinyl chloride resin, a polyvinyl acetate resin, an acrylic resin, a polycarbonate resin, a polyethylene terephthalate resin, a polyethylene resin, a polystyrene resin, a polyolefin resin, a polyurethane resin, and a mixture thereof. Among those, an acrylic/vinyl chloride acetate copolymer resin is preferably used due to its excellent transferability. Also, examples of sub-components to be added include resins having excellent compatibility with the above resins and various types of additives, for example, nitrocellulose. More preferably, the transfer resin layer 20, 21, 22 is such a mixture that 3 parts by weight to 10 parts by weight of nitrocellulose is mixed with 100 parts by weight of the acrylic/vinyl chloride acetate copolymer resin as solid contents. This is because: if the number of parts of nitrocellulose to be added is smaller than 3 parts by weight, a part of the metallic thin film layer 2, 12, 17 is transferred to locations not corresponding to the hot-melt adhesive layer 3, 11, 16, so that the effect of adding nitrocellulose with respect to the transferability becomes small; and if the number of parts of nitrocellulose to be added is larger than 10 parts by weight, since the adhesiveness is deteriorated, there remain areas where satisfactory transfer does not occur even in locations corresponding to the hot-melt adhesive layer 3, 11, 16, so that the effect of improved adhesiveness attained by providing the transfer resin layer 20, 21, 22 becomes small. Further, it is preferable that the film thickness of the transfer resin layer 20, 21, 22 be in a range of 0.5 μm to 2 μm. This is because: if the thickness is smaller than 0.5 μm, protection of the metallic thin film layer 2, 12, 17 becomes insufficient; if the thickness is larger than 2 μm, the transferability is deteriorated; and also, it is necessary to maintain the luster of the metallic thin film layer 2, 12, 17.

It is possible that the protective layer is not provided. However, in the case where the metallic thin film layer 17 is transferred to the resin key top 4 on the side of its surface to be pressed down during operation, it is preferable that the protective layer 18 be provided in view of the necessity of preventing wear occurring due to pressing operation. Also, even in the case where the metallic thin film layer 2, 12 is transferred to the rear surface side of the key top, such as in the push-button switch key top 7, 14, 23, or 24 shown in FIGS. 3A and 3B, FIG. 4, FIG. 6, or FIG. 7, respectively, it is preferable that the protective layer be provided in order to obtain adhesiveness with respect to the colored layer 6, 13 and prevent the metallic thin film layer 2, 12 from being contaminated and oxidized before the colored layer 6, 13 is formed. As the protective layer (protective layer 18 and other), a polymeric protective layer having a film thickness of 1 μm to 60 μm is preferably used, which is obtained by coating an uncured liquid resin and then curing it. Although the type of the liquid resin and methods of coating and curing are not specified here, the liquid resin to be used may be selected from the group consisting of acrylic-based, urethane-based, silicone-based, epoxy-based, ester-based, and the like, each being cured by thermosetting, photosetting, moisture-setting, or the like. The liquid resin may be coated by spray coating, various types of printing, jig coating, and so forth, and then be cured.

The present invention will be described hereinbelow in further detail with reference to specific Examples.

EXAMPLE 1

Example 1 of the invention corresponds to a method of manufacturing a push-button switch key top 7 shown in FIGS. 1A to 3B. That is, a release layer 1*b* is first formed on a polyester-based base film 1*a* having a thickness of 16 μm. Then, an aluminum thin film layer 2 is formed by vacuum deposition on the release layer 1*b* to have a layer thickness of 30 nm and a visible light transmission of 20% to 35% such that the aluminum thin film layer 2 has both a metal-like luster and illuminance (transparency) as a metallic thin film layer 2. Note that the visible light transmission in this example is measured by using a UV-visible spectrophotometer (UV-1600 manufactured by Shimadzu Corporation) and is a transmission read with respect to a wavelength (520 nm) of an LED that is generally used as a backlight light source of electronic equipment such as a mobile telephone. On the other hand, on the rear surface of a polycarbonate resin key top 4 that is formed by molding, a transparent acrylic-based hot-melt adhesive is coated in a die-cut shape corresponding to a display portion 5, to form a hot-melt adhesive layer 3. Next, the aluminum thin film layer 2 is transferred onto the resin key top 4 through the hot-melt adhesive layer 3 having the die-cut shape corresponding to the display portion 5. At this time, only the portions of the aluminum thin film layer 2 which are contact-bonded onto the hot-melt adhesive layer 3 are peeled off from the release layer 1*b* to be provided onto the resin key top 4. Thereafter, a urethane-based white color colored layer 6 is formed by screen printing so as to bury the display portion 5 of the resin key top 4, thereby obtaining the push-button switch key top 7 shown in FIG. 3A. According to this push-button switch key top 7, in a bright location, it exhibits a specular gloss, and the display portion 5 is displayed in a shape of a pulled-out letter (i.e., negative letter), while in a dark location, the entire surface of the resin key top 4 is illuminated by a backlight, and the display portion 5 becomes particularly bright. As a result, visibility thereof becomes excellent.

EXAMPLE 2

Example 2 of the invention corresponds to a method of manufacturing the push-button switch key top 7 shown in FIGS. 1A to 3B. That is, a release layer 1*b* is first formed on a polyester-based base film 1*a* having a thickness of 16 μm Then, an aluminum thin film layer 2 is formed by vacuum deposition on the release layer 1*b* so as to have a layer thickness of 200 nm and a visible light transmission of 0% so that the aluminum thin film layer 2 has both a metal-like luster and illuminance (transparency) as a metallic thin film layer 2. Note that the visible light transmission is the transmission obtained by the same measurement method as used in Example 1 described above. On the other hand, on the rear surface of a polycarbonate resin key top 4 that is formed by molding, a red transparent acrylic-based hot-melt adhesive is coated in a die-cut shape corresponding to a display portion 5 to form a hot-melt adhesive layer 3. Next, the aluminum thin film layer 2 is transferred onto the resin key top 4 through the hot-melt adhesive layer 3 having the die-cut shape corresponding to the display portion 5. At this time, only the portions of the aluminum thin film layer 2 which are contact-bonded onto the hot-melt adhesive layer 3 are peeled off from the release layer 1*b* to be provided onto the resin key top 4. Thereafter, a urethane-based white colored layer 6 is formed by screen printing so as to bury the display portion 5 of the resin key top 4, thereby obtaining the push-button switch key top 7 shown in FIG. 3A. According to this push-button switch key top 7, in a bright location, it exhibits a red specular gloss and the display portion 5 is displayed in a shape of a pulled-out letter (i.e., negative letter), while in a dark location, only the display portion 5 of the resin key top 4 is illuminated by a backlight. As a result, visibility thereof is excellent.

EXAMPLE 3

Example 3 of the invention corresponds to a method of manufacturing a push-button switch key top 14 shown in FIG. 4. That is, a release layer 1*b* is first formed on a polyester-based base film 1*a* having a thickness of 25 μm. Then, a chrome thin film layer 12 is formed by vacuum deposition on the release layer 1*b* so as to have a layer thickness of 20 nm and a visible light transmission of 18% to 37% such that the chrome thin film layer 12 has both a metal-like luster and illuminance (transparency) as a metallic thin film layer 12. Note that the visible light transmission is the transmission obtained by the same measurement method as used in Example 1 described above.

On the other hand, on a polycarbonate resin key top 4 that is formed by molding, a transparent acrylic-based hot-melt adhesive is coated in the same shape as a display portion 5 to form a hot-melt adhesive layer 11. Next, the chrome thin film layer 12 is transferred through the hot-melt adhesive layer 11 having the same shape as the display portion 5. At this time, only the portions of the chrome thin film layer 12 which are contact-bonded onto the hot-melt adhesive layer 11 are peeled off from the release layer 1*b* to be provided onto the resin key top 4. Thereafter, a urethane-based orange colored layer 6 is formed by screen printing on the resin key top 4 excluding the display portion 5, thereby obtaining the push-button switch key top 14 shown in FIG. 4. According to this push-button switch key top 14, in a bright location, the display portion 5 exhibits a specular gloss within the orange rear surface, while in a dark location, the entire surface of the resin key top 4 is illuminated by a backlight and the display portion 5 becomes particularly bright, and in particular the display portion 5 is visible in a shape of a pulled-out letter (i.e., negative letter).

EXAMPLE 4

Example 4 of the present invention relates to a method of manufacturing a push-button switch key top 19 shown in FIG. 5. That is, a release layer 1*b* is first formed on a polyester-based base film 1*a* having a thickness of 25 μm in the same manner as FIG. 1A. Then, an aluminum thin film layer 17 is formed by vacuum deposition on the release layer 1*b* so as to have a layer thickness of 40 nm and a visible light transmission of 8% to 25% such that the aluminum thin film layer 17 has both a metal-like luster and illuminance (transparency) as a metallic thin film layer 17. Note that the visible light transmission is the transmission obtained by the same measurement method as used in Example 1 described above.

On the other hand, on a surface of a translucent PMMA resin key top 4 that is formed by molding, a urethane-based white colored layer 15 is formed by screen printing, and a transparent acrylic-based hot-melt adhesive is coated thereon in a die-cut shape corresponding to a display portion 5 to form a hot-melt adhesive layer 16. Next, the aluminum thin film layer 17 is transferred through the hot-melt adhesive layer 16 coated in the die-cut shape corresponding to the display portion 5. At this time, only the portions of the aluminum thin film layer 17 which are contact-bonded onto the hot-melt adhesive layer 16 are peeled off from the release layer 1*b* to be thus formed on the resin key top 4. Thereafter, a urethane-based protective layer 18 is formed by pad printing on the entire surface of the resin key top 4, thereby obtaining the push-button switch key top 19 shown in FIG. 5. According to this push-button switch key top 19, in a bright location, it exhibits a specular gloss and has a display surface including the display portion 5 formed in a die-cut shape, while in a dark location, the entire surface of the resin key top 4 is illuminated by a backlight and the display portion 5 becomes particularly bright. As a result, visibility thereof is excellent.

EXAMPLE 5

Example 5 of the present invention corresponds to a method of manufacturing a push-button switch key top 23 shown in FIG. 6. Here, after the step of forming the aluminum thin film layer 2 by vacuum deposition in Example 1, the aluminum thin film layer 2 is coated by gravure printing with a mixture in which nitrocellulose is mixed at a solid content weight ratio of 20:1 relative to an acrylic/vinyl chloride acetate-based coating medium (20 wt % of acrylic/80 wt % of vinyl chloride acetate), thereby forming a transfer resin layer 20 having a thickness of 1 μm which is colorless and transparent. Except for the above step, the same steps as in Example 1 are performed to obtain the push-button switch key top 23. According to this push-button switch key top 23, in a bright location, it exhibits a specular gloss and its display portion 5 is displayed in a shape of a pulled-out letter (i.e., negative letter), while in a dark location, the entire surface of the resin key top 4 is illuminated by a backlight and the display portion 5 becomes particularly bright. As a result, visibility thereof is excellent. Also, there occurs no need for a burr removal step after transferring the metallic thin film layer 2.

EXAMPLE 6

Example 6 of the present invention also corresponds to a method of manufacturing the push-button switch key top 23 shown in FIG. 6. Here, after the step of forming the aluminum thin film layer 2 by vacuum deposition in Example 2, the aluminum thin film layer 2 is coated by gravure printing with a compound in which nitrocellulose is mixed at a solid content weight ratio of 20:1 relative to an acrylic/vinyl chloride acetate-based coating medium (20 wt % of acrylic/80 wt % of vinyl chloride acetate), thereby forming a transfer resin layer 20 having a thickness of 1 μm which is colorless and transparent. Except for the above step, the same steps as in Example 2 are performed to obtain the push-button switch key top 23. According to this push-button switch key top 23, in a bright location, it exhibits a red specular gloss and its display portion 5 is displayed in a shape of a pulled-out letter (i.e., negative letter), while in a dark location, only the display portion 5 of the resin key top 4 is illuminated by a backlight. As a result, visibility thereof is excellent. Also, there occurs no need for a burr removal step after transferring the metallic thin film layer 2.

EXAMPLE 7

Example 7 of the present invention corresponds to a method of manufacturing a push-button switch key top 24 shown in FIG. 7. Here, after the step of forming the chrome thin film layer 12 by vacuum deposition in Example 3, a step is performed in which the chrome thin film layer 12 is coated by gravure printing with a compound in which nitrocellulose is mixed at a solid content weight ratio of 20:1 relative to an acrylic/vinyl chloride acetate-based coating medium (20 wt % of acrylic/80 wt % of vinyl chloride acetate), thereby forming a transfer resin layer 21 having a thickness of 1 μm. Except for the above step, the same steps as in Example 3 are performed to obtain the push-button switch key top 24. According to this push-button switch key top 24, in a bright location the display portion 5 exhibits a specular gloss within an orange rear surface, while in a dark location the entire surface of the resin key top 4 is illuminated by a backlight and thus bright, and the display portion 5 is visible in a shape of a pulled-out letter (i.e., negative letter). Also, there occurs no need for a burr removal step after transferring the metallic thin film layer 12.

EXAMPLE 8

Example 8 of the present invention corresponds to a method of manufacturing a push-button switch key top 25 shown in FIG. 8. Here, after the step of forming the aluminum thin film layer 17 by vacuum deposition in Example 4, a step is performed in which the aluminum thin film layer 17 is coated by gravure printing with a compound in which nitrocellulose is mixed at a solid content weight ratio of 20:1 relative to an acrylic/vinyl chloride acetate-based coating medium (20 wt % of acrylic/80 wt % of vinyl chloride acetate), thereby forming a transfer resin layer 22 having a thickness of 1 $\mu$m. Except for the above step, the same steps as in Example 4 are performed to obtain the push-button switch key top 25. According to this push-button switch key top 25, in a bright location, its display surface includes the display portion 5 having a specular gloss and a die-cut shape, while in a dark location, the entire surface of the resin key top 4 is illuminated by a backlight and the display portion 5 becomes particularly bright. As a result, visibility thereof is excellent. Also, there occurs no need for a burr removal step after transferring the metallic thin film layer 17.

EXAMPLE 9

According to Example 9 of the invention, instead of forming the aluminum thin film layer 2 on the release layer 1*b* in Example 1, a protective layer (not shown) is first formed on the release layer 1*b*, and thereafter, the aluminum thin film layer 2 is formed thereon. Then, the protective layer is transferred onto the resin key top 4 together with the aluminum thin film layer 2. Except for the above step, a push-button switch key top (not shown) is obtained in the same manner as in Example 1. According to this push-button switch key top, in a bright location, it exhibits a specular gloss and its display portion is displayed in a shape of a pulled-out letter (i.e., negative letter), while in a dark location, the entire surface of the resin key top 4 is illuminated by a backlight and the display portion becomes particularly bright. As a result, visibility thereof is excellent. Also, there is observed no adhesion of dirt or degradation in the aluminum thin film layer 2.

EXAMPLE 10

According to Example 10 of the invention, instead of forming the aluminum thin film layer 2 on the release layer 1*b* in Example 5, a protective layer (not shown) is first formed on the release layer 1*b*, and thereafter, the aluminum thin film layer 2 is formed thereon. Then, the aluminum thin film layer 2 and the protective layer are transferred onto the resin key top 4 through a transfer resin layer. Except for the above step, a push-button switch key top (not shown) is obtained in the same manner as in Example 5. According to this push-button switch key top, in a bright location, it exhibits a specular gloss and its display portion is displayed in a shape of a pulled-out letter (i.e., negative letter), while in a dark location, the entire surface of the resin key top 4 is illuminated by a backlight and the display portion becomes particularly bright. As a result, visibility thereof is excellent. Also, there occurs no need for a burr removal step after transferring the metallic thin film layer.

Industrial Applicability

According to the method of manufacturing the push-button switch key top of the present invention, the hot-melt adhesive layer is formed in advance in a shape corresponding to the display portion, and the metallic thin film layer is then transferred onto this hot-melt adhesive layer, whereby no damage is caused to the metallic thin film layer due to coating of the hot-melt adhesive layer. In addition, the hot-melt adhesive layer is formed in advance on the resin key top in a shape corresponding to the display portion, whereby there is no need for positional alignment of the display portion when the metallic thin film layer is to be transferred onto the resin key top. Accordingly, the resin key top with high quality can be obtained, enabling improved yield. Further, this manufacturing method utilizes the hot-melt adhesive layer that is easy to handle and excellent in quick-drying property. Accordingly, production efficiency can be improved as compared with the conventional vapor deposition or the like.

Furthermore, according to the method of manufacturing the push-button switch key top of the present invention in which the transfer resin layer is further formed on the metallic thin film layer, the metallic thin film layer can be prevented from undergoing oxidization due to air, moisture, or the like, and even in the case where it is touched by hand during manufacturing operation, adhesion of dirt or occurrence of damage to the metallic thin film layer can be prevented. In addition, the presence of the transfer resin layer increases the adhesive force with respect to the hot-melt adhesive layer, whereby the resin key top with high quality can be obtained in which the transfer property of the metallic thin film layer is improved.

While the invention has been specifically described in connection with specific embodiments thereof, it is to be understood that this is by way of illustration and not of limitation, and the scope of the appended claims should be construed as broadly as the prior art will permit.

What is claimed is:

1. A method of manufacturing a key top for a push-button switch, comprising the steps of:

forming a hot-melt adhesive layer on a resin key top so as to have a shape corresponding to a display portion for displaying a letter, symbol, or other indicia;

forming a metallic thin film layer on a releasable sheet material;

forming a transfer resin layer made by a thermoplastic resin in advance on the metallic thin film layer; and transferring the metallic thin film layer onto the hot-melt adhesive layer through the transfer resin layer to thereby form a resin key top with a metallic tint, wherein the transfer resin layer is disposed between the hot-melt adhesive and the metallic thin film layer.

2. A method of manufacturing a key top for a push-button switch according to claim 1, wherein the hot-melt adhesive layer is formed by coating a hot-melt adhesive on the resin key top so as to have a die-cut shape corresponding to the display portion.

3. A method of manufacturing a key top for a push-button switch according to claim 1, wherein the hot-melt adhesive layer is formed by coating a hot-melt adhesive on the resin key top so as to have the same shape as the display portion.

4. A method of manufacturing a key top for a push-button switch according to claim 1, further comprising the steps of:

forming a protective layer on the releasable sheet material;

forming the metallic thin film layer on the protective layer in laminate; and thereafter transferring the metallic thin film layer and the protective layer onto the hot-melt adhesive layer at the same time.

5. A method of manufacturing a key top for a push-button switch according to claim 1, wherein the metallic thin film layer is formed so as to have a thickness of 5 nm to 100 nm and exhibit both metallic luster and illuminance that is attained by transmitting light from a backlight built in a push-button switch.

6. A method of manufacturing a key top for a push-button switch according to claim 1, wherein the metallic thin film layer is formed so as to have a thickness of 10 nm to 50 nm and exhibit both metallic luster and illuminance that is attained by transmitting light from a backlight built in a push-button switch.

7. A method of manufacturing a key top for a push-button switch according to claim 1, wherein the metallic thin film layer is formed so as to have a visible light transmission of 1 to 60% and have both a metallic luster and illuminance that is attained by transmitting light from a backlight built in a push-button switch.

8. A method of manufacturing a key top for a push-button switch according to claim 1, wherein the metallic thin film layer is formed so as to have a visible light transmission of 5 to 40% and have both a metallic luster and illuminance that is attained by transmitting light from a backlight built in a push-button switch.

9. A method of manufacturing a key top for a push-button switch according to claim 1, wherein the releasable sheet material is a base film which has a releasable layer.

10. A method of manufacturing a key top for a push-button switch according to claim 1, comprising the steps of:

after transferring a metallic thin film layer onto the hot-melt adhesive layer, forming a colored layer in the remaining portion which is the metallic thin film layer transferred.

11. A key top for a push-button switch, said key top being manufactured by a process comprising the steps of:

forming a hot-melt adhesive layer on a resin key top so as to have a shape corresponding to a display portion for displaying a letter, symbol, or other indicia;

forming a metallic thin film layer on a releasable sheet material;

forming a transfer resin layer made by a thermoplastic resin in advance on the metallic thin film layer; and transferring the metallic thin film layer onto the hot-melt adhesive layer through the transfer resin layer to thereby form a resin key top with a metallic tint, wherein the transfer resin layer is disposed between the hot-melt adhesive and the metallic thin film layer.

12. The key top according to claim 11, wherein the hot-melt adhesive layer is formed by coating a hot-melt adhesive on the resin key top so as to have a die-cut shape corresponding to the display portion.

13. The key top according to claim 11, wherein the hot-melt adhesive layer is formed by coating a hot-melt adhesive on the resin key top so as to have the same shape as the display portion.

14. The key top according to claim 11, wherein the process further comprises the steps of:

forming a protective layer on the releasable sheet material;

forming the metallic thin film layer on the protective layer in laminate; and thereafter transferring the metallic thin film layer and the protective layer onto the hot-melt adhesive layer at the same time.

15. The key top according to claim 11, wherein the metallic thin film layer has a thickness of 5 nm to 100 nm and exhibits both metallic luster and illuminance that is attained by transmitting light from a backlight built in a push-button switch.

16. The key top according to claim 11, wherein the metallic thin film layer has a thickness of 10 nm to 50 nm and exhibits both metallic luster and illuminance that is attained by transmitting light from a backlight built in a push-button switch.

17. The key top according to claim 11, wherein the metallic thin film layer has a visible light transmission of 1 to 60% and has both a metallic luster and illuminance that is attained by transmitting light from a backlight built in a push-button switch.

18. The key top according to claim 11, wherein the metallic thin film layer has a visible light transmission of 5 to 40% and has both a metallic luster and illuminance that is attained by transmitting light from a backlight built in a push-button switch.

19. The key top for a push-button switch according to claim 11, wherein the releasable sheet material is a base film which has a releasable layer.

20. The key top for a push-button switch according to claim 11, wherein the process further comprises the steps of:

after transferring a metallic thin film layer onto the hot-melt adhesive layer, forming a colored layer in the remaining portion which is the metallic thin film layer transferred.

* * * * *